US005150650A

United States Patent [19]

Murakami

[11] Patent Number: 5,150,650

[45] Date of Patent: Sep. 29, 1992

[54] CLEANER FOR ROTARY BODIES SUCH AS BLANKET CYLINDER, IMPRESSION CYLINDER, INK SUPPLY ROLLERS AND THE LIKE

[76] Inventor: Yoshichika Murakami, 17-4, Sugao 5-Chome, Miyamae-ku, Kawasaki-shi, Kanagawa-ken, Japan

[21] Appl. No.: 576,018

[22] Filed: Aug. 31, 1990

[30] Foreign Application Priority Data

Sep. 1, 1989 [JP] Japan ..... 1-224560
Apr. 6, 1990 [JP] Japan ..... 2-91778

[51] Int. Cl.[5] ..... B41F 35/00
[52] U.S. Cl. ..... 101/425; 101/423
[58] Field of Search ..... 101/423, 424, 425; 15/256.51, 256.53; 242/74.1, 74.2, 75, 75.2, 75.4, 75.45

[56] References Cited

U.S. PATENT DOCUMENTS 2,525,982 10/1950 Wescott ..... 101/425
4,344,361 8/1982 MacPhee et al. ..... 101/425
4,650,311 3/1987 Mayer ..... 15/256.51
4,915,319 4/1990 Gerber ..... 242/75.4
4,953,252 9/1990 Akisawa ..... 15/256.51
4,953,463 9/1990 Hara ..... 101/425
4,991,507 2/1991 Nozaka et al. ..... 101/425

*Primary Examiner*—Edgar S. Burr
*Assistant Examiner*—Ren Yan
*Attorney, Agent, or Firm*—Bruce L. Adams; Van C. Wilks

[57] ABSTRACT

A cleaner for rotary bodies such as a blanket cylinder, impression cylinder, ink supply roller and the like includes a cleaning cloth stretched between two supporting points. The cleaning cloth is pressed against the peripheral surface of the rotary body, and a supply means supplies cleaning material to the back of the cleaning cloth. The cleaning cloth is advanced in a direction opposite to the rotation of the peripheral surface of the rotary body to be washed.

26 Claims, 12 Drawing Sheets

CLEANER FOR ROTARY BODIES SUCH AS BLANKET CYLINDER, IMPRESSION CYLINDER, INK SUPPLY ROLLERS AND THE LIKE

BACKGROUND OF THE INVENTION

The present invention relates to a cleaner for rotary bodies such as blanket cylinder, impression cylinder, ink supply rollers and the like used for printing.

There have been known, as a cleaner for a peripheral surface of a blanket cylinder used for printing, cleaners having a construction in which a cleaning cloth is successively brought into contact with the peripheral surface of the blanket cylinder by a press means. In the conventional cleaner, the contact between the cleaning cloth and the peripheral surface of the blanket cylinder is made linearly. Hence, cleaning takes a long time and requires a large cleaning cloth. Also, the construction of the conventional cleaner is complicated.

SUMMARY OF THE INVENTION

An object of the present invention is to provide a cleaner which has excellent cleaning ability and is capable of cleaning in less time using less cleaning cloth. Another object is to provide a cleaner which has a simplified structure and can be operated easily.

In order to accomplish the above objects, the present invention provides a cleaner comprising a cleaning cloth that is stretched between two supporting points so that it may come into surface contact with and may be pressed against the peripheral surface of rotary bodies such as a blanket cylinder, impression cylinder, ink supply rollers, etc., and means for supplying a cleaning liquid onto the back of the cleaning cloth, wherein the cleaning cloth is advanced in a direction opposite to the rotation of the peripheral surface of the rotary bodies.

BRIEF DESCRIPTION OF THE DRAWING

Hereinbelow, the present invention is described in detail with reference to attached drawings.

DETAILED DESCRIPTION OF THE PREFERRED EMBODIMENT

Figure 1:
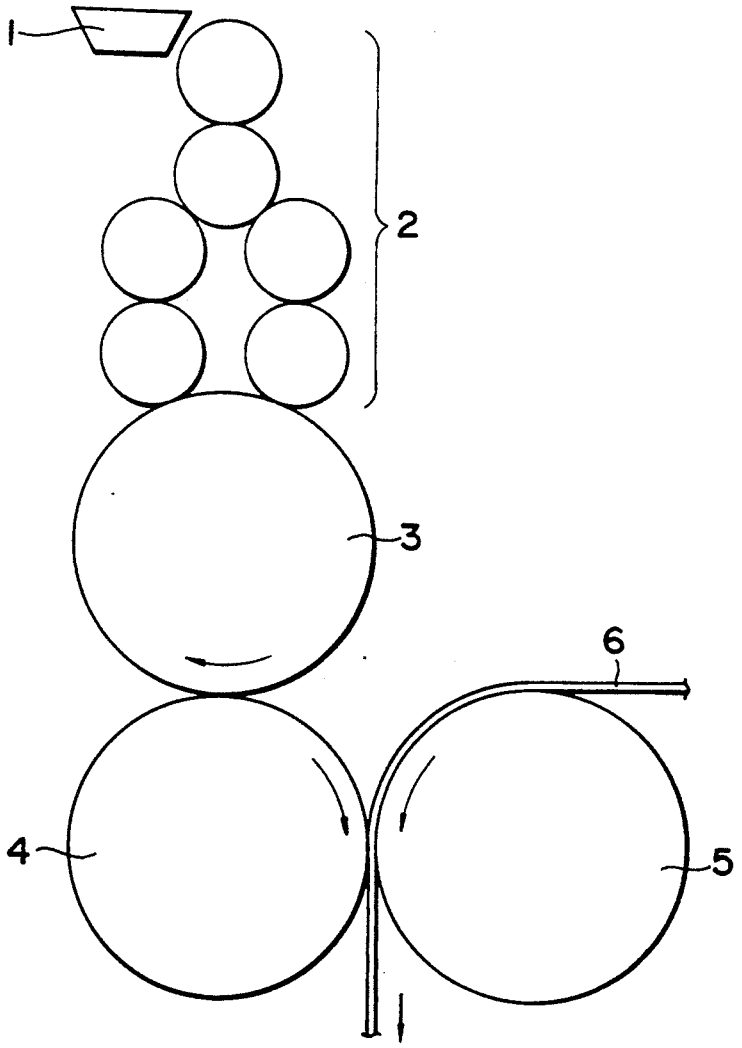
FIG. 1 is a schematic view of a general offset printing machine.

FIG. 1 shows an offset printing machine. In this printing machine, printing ink is supplied from an ink fountain 1 to a plate surface of a plate cylinder 3 by way of ink supply rollers 2 and applied by coating. The inked images on the plate surface are transferred onto the peripheral surface of the blanket cylinder 4 made of rubber, and then transferred to a printing paper 6 advanced between the blanket cylinder 4 and the impression cylinder 5. In this printing step, the print quality is lowered when debris such as dust, paper dust, ink, etc. adhere onto the rotary bodies such as the blanket cylinder 4, impression cylinder 5, ink supply rollers 2, etc. Hence, it is necessary to remove the debris from the rotary bodies. The removing operation will be described by referring to the case using the blanket cylinder 4 as the rotary bodies.

Figure 4:
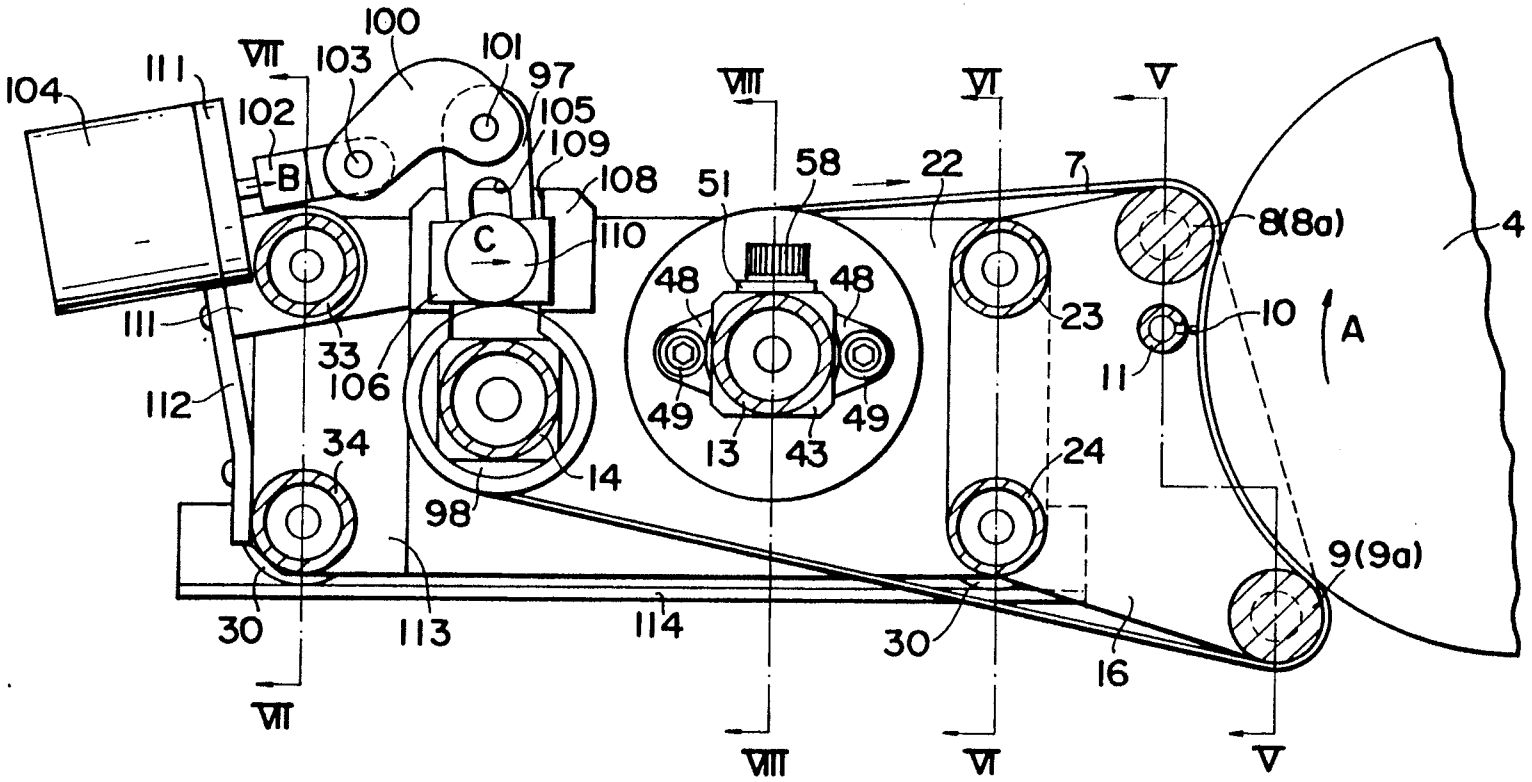
FIG. 4 is a sectional view taken along line IV—IV of FIG. 3.

As shown in FIG. 4, a cleaning cloth 7 is stretched between two supporting points 8 and 9. Disposed on the back side of the cleaning cloth 7 is a jet tubular member 11 having jet openings 10 which spray cleaning liquid onto the cleaning cloth 7 from the back. The cleaning cloth 7 between the two supporting points 8 and 9 containing the cleaning liquid is advanced in a direction opposite to the rotation of the blanket cylinder 4 to wash the peripheral surface of the blanket cylinder 4 while being pressed against the peripheral surface of the rotary bodies such as the blanket cylinder 4, impression cylinder 5, ink supply rollers 2, etc. The cleaning cloth 7 is also used for sweeping the used cleaning liquid on the blanket cylinder 4. Hence, the cleaner of the present invention is excellent in cleaning ability per unit time, capable of shortening the cleaning time, uses a small amount of the cleaning cloth, and has a simplified construction.

The cleaning cloth 7 is composed of non-woven fabric and wound around an axis 12 in the roll-like state. The axis 12 is fitted in a cleaning cloth supply roll 13 so that these can rotate integrally. The cleaning cloth supply roll 13 is applied with a constant brake. One end of the cleaning cloth 7 is wound around an axis 15 which is integrally rotatably fitted in a cleaning cloth take-up roll 14 by way of the supporting points 8 and 9, and is taken up by the take-up roll. A new portion of the cleaning cloth 7 can be supplied by the take-up roll.

One of the two supporting points 8 for supporting the cleaning cloth 7 with tension is disposed at an angle portion formed by an upper edge and a front edge of a bracket 16, while another supporting point 9 is disposed at a corner portion formed by a front edge and a lower edge. These supporting points 8 and 9 extend between both brackets 16, 16 and are fitted on them. The lower supporting point 9 is positioned obliquely to the front of the upper supporting point 8 and faces toward the direction opposite to the rotation A of the blanket cylinder 4.

Figure 11:
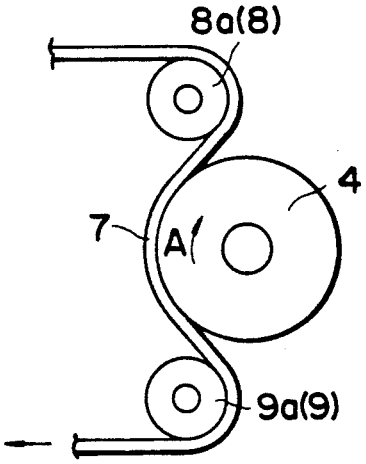
FIGS. 11 (*a*) to (*d*) are schematic views showing various embodiments of the inventive cleaning processes.
Figure 11:
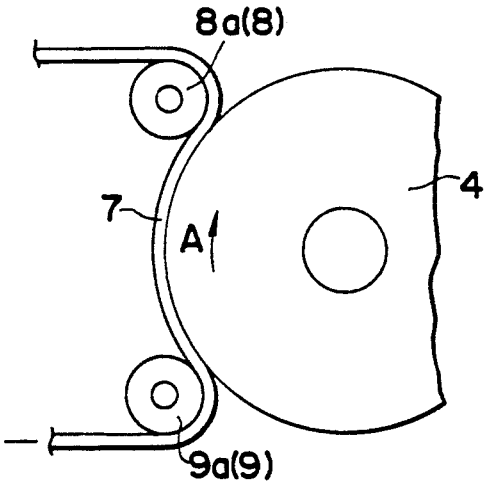
Figure 11:
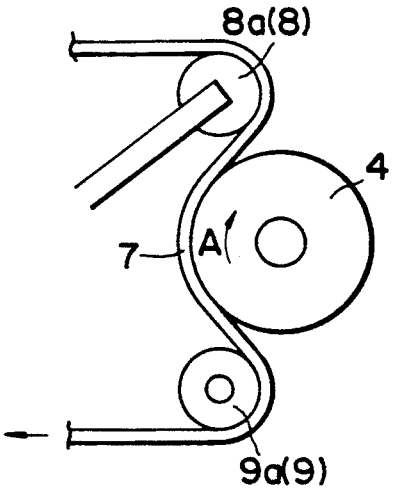
Figure 11:
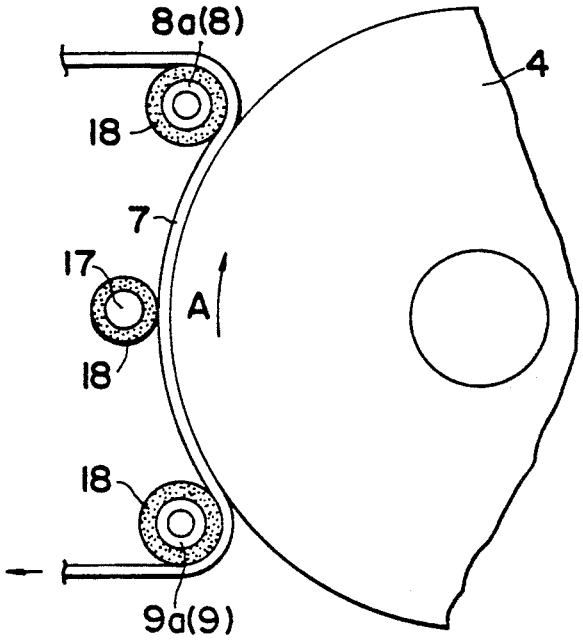

As an example of the two supporting points 8 and 9, the supporting point 8 at the supplying side and the supporting point 9 at the taking-up side may be constituted by the rotary rolls 8*a* and 9*a*, respectively (FIGS. 11*a, b* and *d*). The supporting point 8 at the supplying side may be constituted by a nonrotatable stationary body 8*a*, while the supporting point 9 at the taking-up side may be constituted by a rotary roll 9*a* (FIG. 11*c*). Moreover, at least one press roll 17 may be disposed between both supporting points 8 and 9 so as to press the cleaning cloth 7 stretched supporting points against the blanket cylinder 4 (FIG. 11*d*). Further, the contact with the blanket cylinder 4 may be made only by the cleaning cloth 7 between the two supporting points 8 and 9 and the blanket cylinder 4 (FIGS. 11 *a* and *c*). Alternately, rotary rolls 8*a* and 9*a* at the supporting points may be pressed against the blanket cylinder 4 through the cleaning cloth 7 (FIGS. 11*b* and *d*). In this construction, a peripheral surface 18 of the rotary rollers 8*a* and 9*a* should preferably be made of a flexible, elastic material such as rubber, synethetic resins, etc. (FIG. 11*d*). When a press roll 17 is used, the peripheral surface 18 of this roll should also preferably be composed of the above elastic material.

In a construction in which at least the supporting point 9 on the taking-up side is the rotatable roll 9*a* among the supporting points 8 and 9, the advancement of the cleaning cloth is made smooth. In a construction in which the both supporting points 8 and 9 are rotatable rolls, the advancement of the cleaning cloth is made smoother. In a construction that the cleaning cloth 7 stretched between both supporting points 8 and 9 is pressed by a press roll 17 between these supporting points, washing is done more efficiently. In a construction that the rolls at both supporting points 8*a* and 9*a* and the roll 17 between them are composed of elastic material, when the roll is pressed against the blanket cylinder 4 through the cleaning cloth 7, the removal of paper dust, ink, etc. on the surface of the blanket cylinder can be easily conducted to clean more efficiently as compared with the case of using rigid material such as metals.

Figure 5:
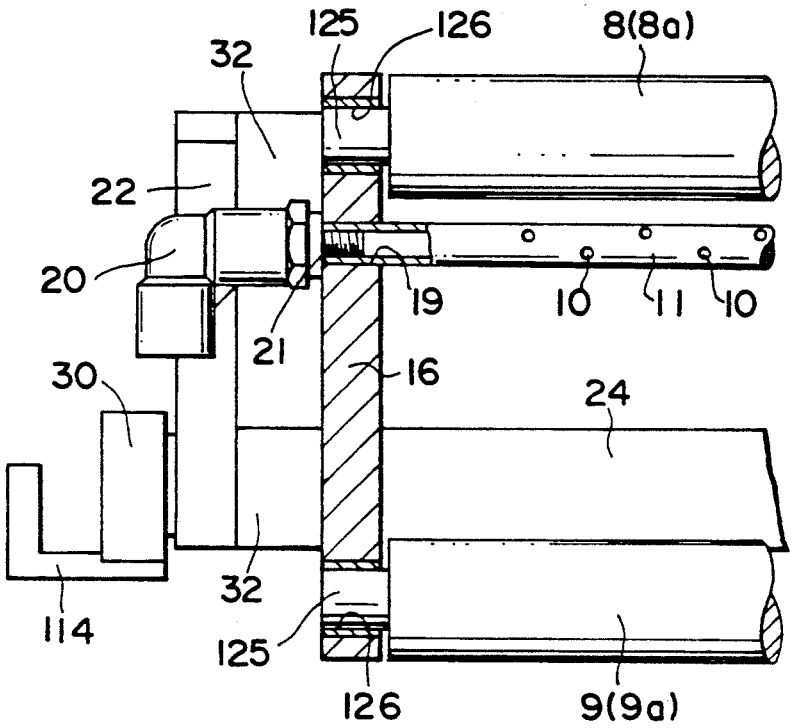
FIG. 5 is a sectional view taken along line V—V of FIG. 4.

The jet tubular member 11 has a length equal to the distance between brackets 16, 16, and is inserted at both ends into openings 19, 19 of the brackets and fixed by a screw means 21 of an elbow 20 (FIG. 5). Jet openings 10 are bored over substantially the whole length of the jet tubular member 11 and may be equally spaced apart. Cleaning liquid is supplied from the elbow 20 at both ends of the jet tubular member 11 and sprayed on the back of the cleaning cloth 7 from the jet openings 10.

Figure 6:
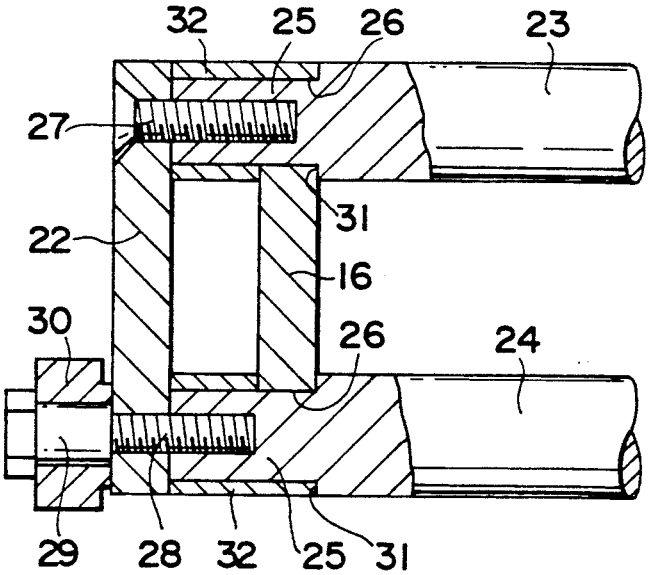
FIG. 6 is a sectional view taken along line VI—VI of FIG. 4.
Figure 7:
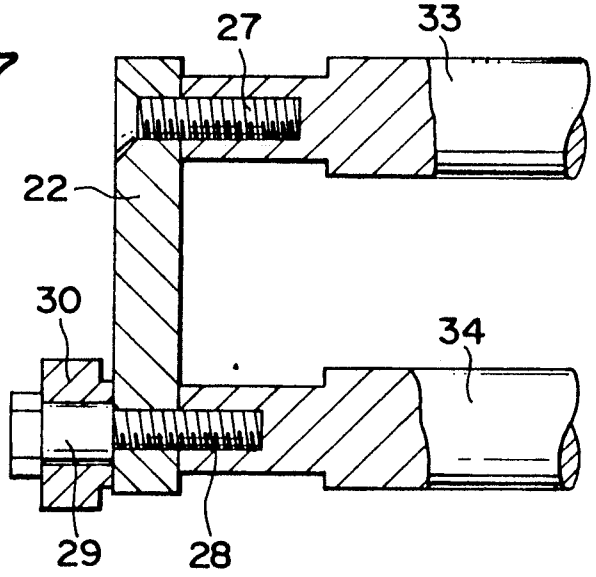
FIG. 7 is a sectional view taken along line VII—VII of FIG. 4.

Both brackets 16, 16 are arranged inside side frames 22, 22 and these brackets 16, 16 and the side frames 22, 22 are connected to each other by connecting rods 23, 24 and maintain a predetermined distance (FIG. 6). The connecting rods 23, 24 extend through openings 26, 26 of the brackets 16, 16. Reduced diameter sections 25, 25 at the end portions of the connecting rods abut to the side frames 22, 22 and are fixed to the side frames by screw means 27, 28 (FIG. 6). The screw means 28 has a shaft 29 at the end portion and the shaft supports a roller 30 (FIG. 6). Shoulders 31, 31 of the connecting rods 23, 24 are engaged with the edge of the opening 26 of the bracket 16 to the maintain the distance between the brackets 16, 16 (FIG. 6). The edge surfaces of the connecting rods 23, 24 maintain the distance between both side frames 22, 22. Further, a short tubular spacer 32 inserted into the reduced diameter section 25 maintains the distance between the bracket 16 and the side frame 22 (FIG. 6). Connecting rods 33, 34 abut at both ends against the side frames 22, 22 to maintain the distance between the side frames similarly to the connecting rods 23, 24 and are fixed by screw means 27, 28. The screw means 28 supports the roller 30 (FIG. 7).

Figure 3:
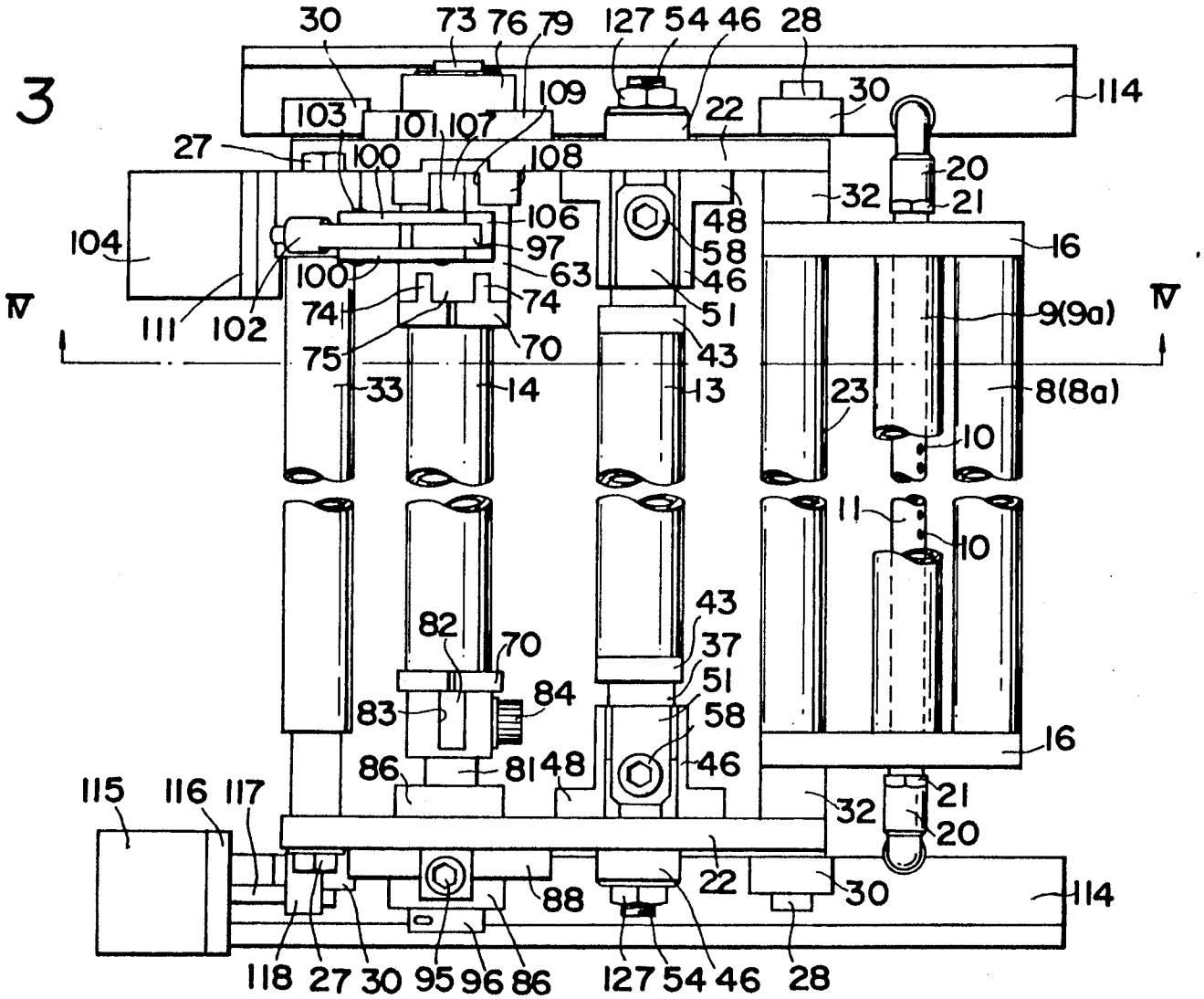
FIG. 3 is a plan view of an embodiment of the present invention.
Figure 8:
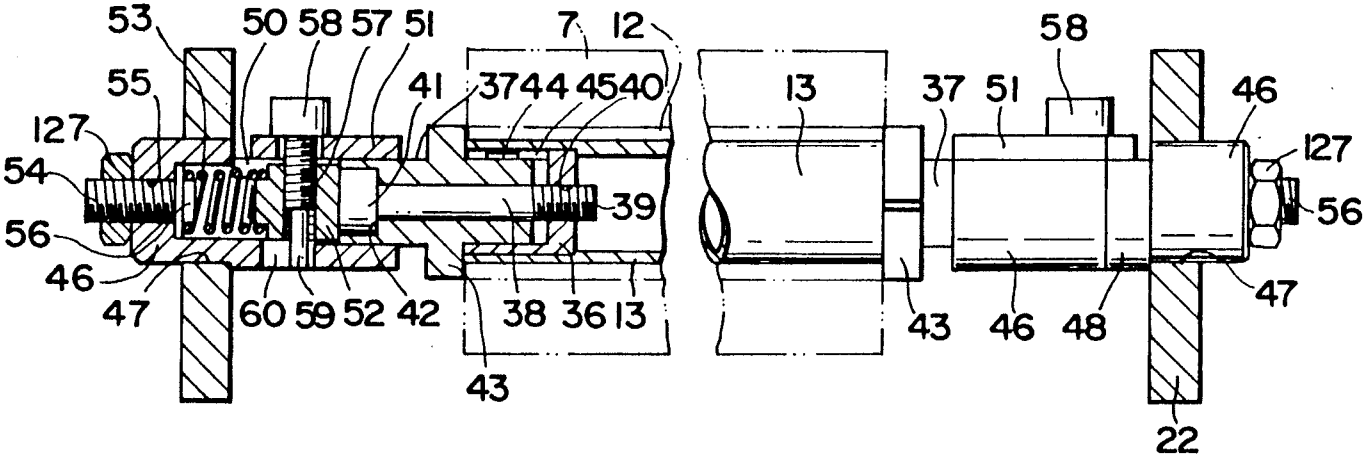
FIG. 8 is a sectional view taken along line VIII—VIII of FIG. 4.

The supply roll 13 has a connecting socket 36 inserted into the opening at both ends as shown in FIG. 8. These connecting sockets 36 receive a short shaft 37 which is inserted in the openings, and the short shaft 37 is connected to the connecting socket 36 by a bolt 38. The bolt 38 extends into a vertical opening of the short shaft 37. The bolt 38 has a threaded portion 39 which screws in a tapped opening 40 of the connecting socket 36, and a head 41 which is engaged with a shoulder 42 of the short shaft 37 (FIG. 8). When the bolt 38 is tightened up, the short shaft 37 is moved in such a direction that both become closer, and an outer flange 43 of the short shaft clamps the axis 12 of the supply roll 13 for the cleaning cloth 7. Hence, the axis 12 rotates integrally with the supply roll 13. When the bolt 38 is loosened to separate the short shaft 37 from the connecting socket 36, the axis 12 can be removed from the supply roll 13. The short shaft 37 and the connecting socket 36 rotate integrally by the engagement of a key 44 on the short shaft side and a key way 45 on the connecting socket side. A bearing 46 for the short shaft 37 extends into the openings 47 of the side frames 22, 22, and a flange 48 of the bearing is fixed to the inside surface of the side frame 22 by means of a screw 49 (FIG. 3 and FIG. 4). The bearing 46 has an opening 50 at an upper part of the periphery thereof. The shaft 37 is inserted into and removed from the bearing 46 through the opening (FIG. 8). The opening 50 is opened and closed by a cover or cap 51 to confine the shaft 37 within the bearing 46. A brake shoe 52 and a compression coiled spring 53 are incorporated in the bearing 46 (FIG. 8). The spring 53 presses the brake shoe 52 against the end surface of the short shaft 37 to apply braking power to the short shaft. An adjust screw 54 is screwed in a tapped opening 55 of the outer end surface of the bearing 46, and a spring bearing 56 is disposed between the screw 54 and the spring 53. When the screw 54 is tightened, the press power of the brake shoe 52 against the end surface of the short shaft 37 is strengthened by the spring bearing 56 and the spring 53, while the screw is loosened, the press power of the brake shoe is reduced to adjust the braking power. As a result, the stretching power applied to the cleaning cloth 7 is appropriately adjusted.

The brake shoe 52 has a tapped opening 57 in which a bolt 58 is screwed, and the bolt connects the cover 51 to the brake shoe 52. An end portion 59 of the bolt 58 is slidably inserted into a longitudinal slot 60 of the bearing 46 to inhibit the rotation of the brake shoe 52. By tightening the bolt 58, the cover 51 is fixed in the closed position, while by loosening the bolt 58, the cover 51 can be rotated around the bolt as a center to an opening or closing position. The supply roll 13 can be easily removed from and incorporated into the bearing 46 by opening the cover 51. The supply roll 13 can be confined within the bearing by closing the cover. The cleaning cloth 7 can be easily supplied to the cleaner by this operation. A nut 127 is screwed on the adjust screw 54 to prevent the adjust screw from loosening.

Figure 9:
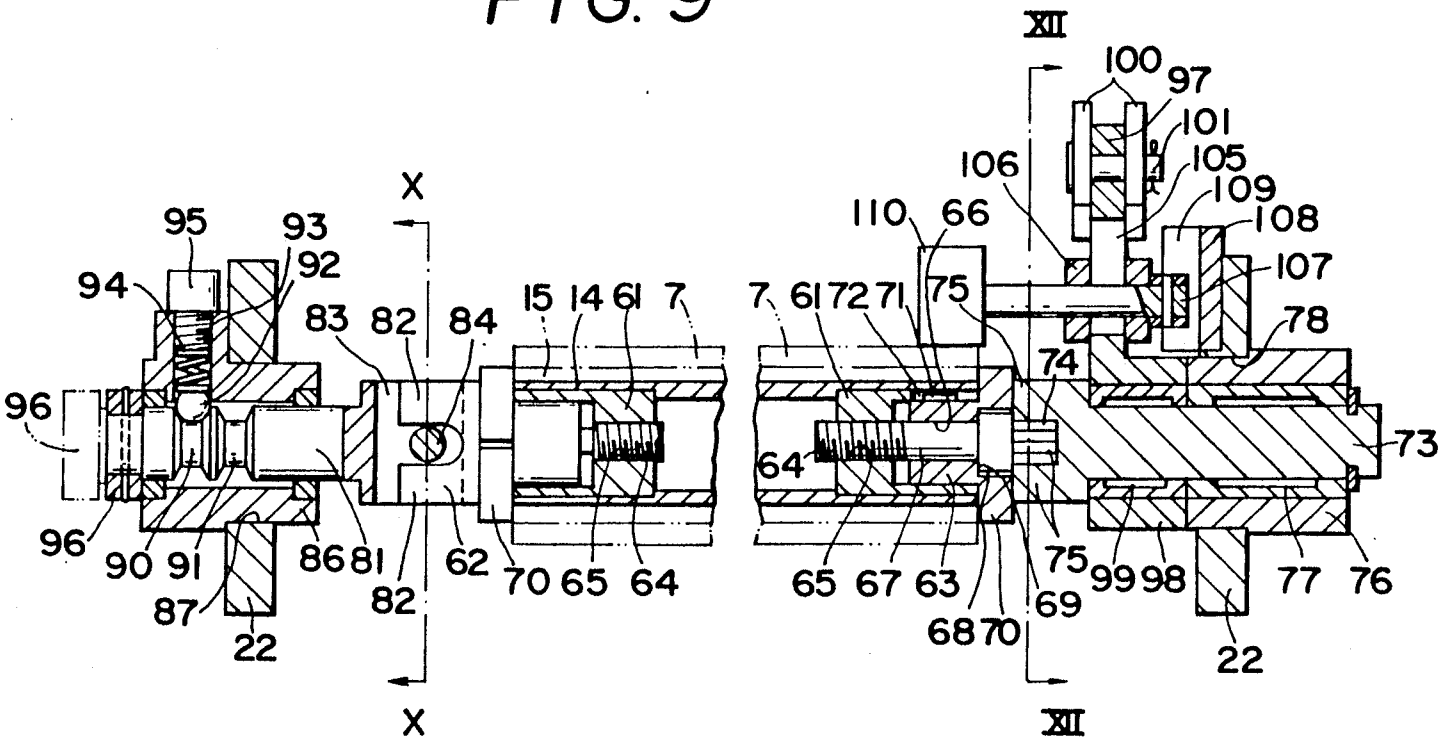
FIG. 9 is a sectional view taken along line IX—IX of FIG. 4.

The take-up roll 14 has connecting sockets 61, 61 inserted under pressure into openings at both ends as shown in FIG. 9. These connecting sockets 61, 61 receive connecting members 62, 63 inserted in the openings of the socket. The connecting member 62 has a threaded portion 64. The threaded portion 64 is screwed in a tapped opening 65 of the connecting socket 61 to fix the connecting member 62 to the take-roll 14. Another connecting member 63 is fixed by screwing between the threaded portion 64 of the bolt 67 which extends through an opening 66 of the member and the tapped opening 65 of the connecting socket 63. A head 68 of a bolt 67 is engaged with a shoulder 69 of the connecting member 63. By tightening the bolt 67, the connecting member 63 moves in such a direction that it becomes closer to the side of the connecting member 63 to clamp the axis 15 for the cleaning cloth on the take-up roll 14 by flanges 70, 70 of both connecting members. The axis 15 can rotate integrally with the take-up roll 14 by this operation. The axis 15 can be removed from the take-up roll 14 by loosening the bolt 67 and thereby separating the connecting member 63 from the connecting socket 61. The connecting member 63 and the connecting socket 61 can rotate integrally by the engagement of a key 71 on the side of the connecting member 63 and a key way 72 on the side of the connecting socket 61.

The connecting member 63 is connected to a shaft 73 by means of a connecting means. As the connecting means, four claws 74, 75 engaging each other are formed on an abutment surface formed by the connecting member 63 and the shaft 73 (FIG. 3 and FIG. 9). The claw 74 and the connecting member 63 constitute one body and the claw 75 and the shaft 73 constitute another body.

These claws 74, 75 get into and out of mesh by relative movement in an axial direction, and transfer the rotating force relatively at the position of mesh. The shaft 73 is inserted into a bearing 76 fixed to the side frame 22. A one-way clutch 77 is disposed between the shaft 73 and the bearing 76. Hence, the shaft 73 is rotatable only in the direction of supplying the cleaning cloth. The bearing 76 is inserted into an opening 78 of the side frame 22. A flange 79 of the bearing 76 is fixed to the outer side surface of the side frame 22 by means of a screw means 80 (FIG. 3 and FIG. 9).

Figure 2:
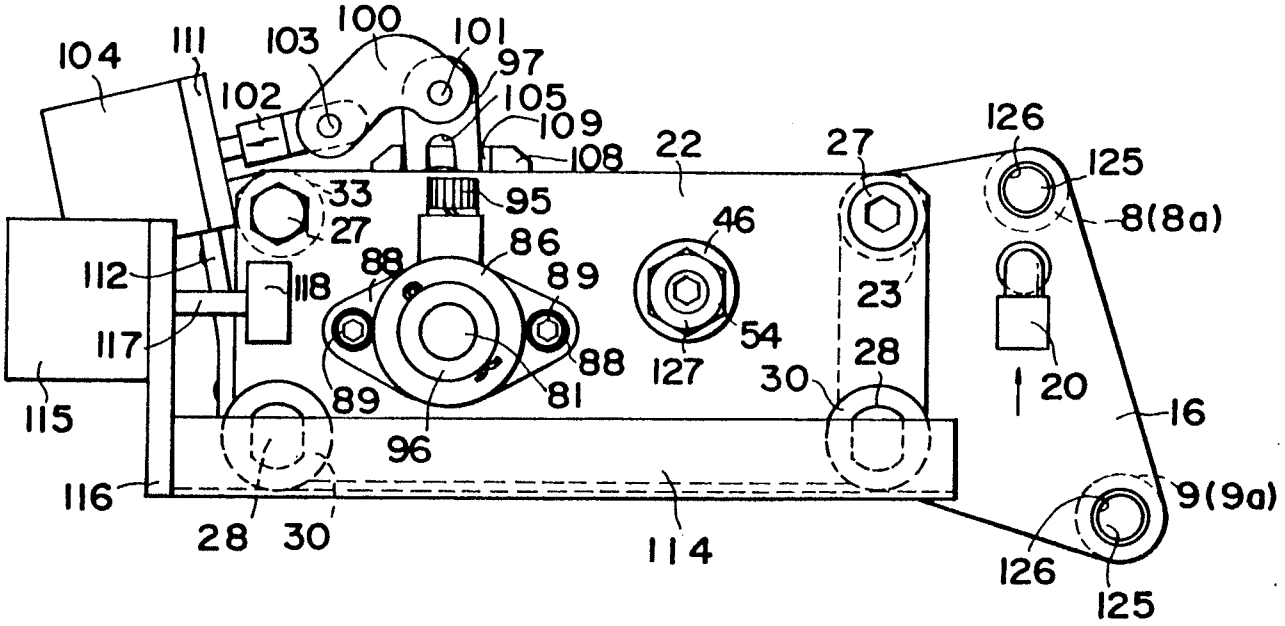
FIG. 2 is a side view showing an embodiment of the present invention.
Figure 10:
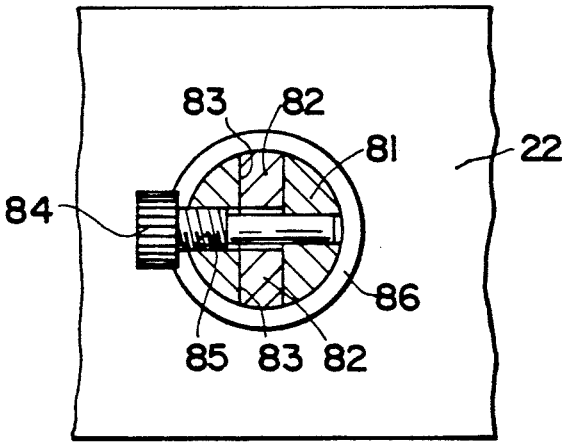
FIG. 10 is a sectional view taken along line X—X of FIG. 9.

The connecting member 62 is connected to a short shaft 81 by using a connecting means as shown in FIG. 9. As the connecting means, a pair of claws 82 are formed on an abutment surface on the side of the connecting member 62, and a slot 83 engaging with the claw 82 is formed on an abutment surface on the side of the short shaft 81. A pin 84 crossing the slot 83 and extending between the claws 82 is screwed in a tapped opening 85 of the short shaft 81 (FIG. 10). The claw 82, slot 83 and pin 84 get in and out of engagement by relative movement in the axial direction and rotate integrally in the engaging state. The short shaft 81 is supported by a bearing 86 fixed to the side frame 22, the bearing 86 is inserted in an opening 87 of the side frame 22, and a flange 88 of the bearing 86 is fixed to the outer side surface of the side frame 22 by means of a screw means 89 (FIG. 2).

The short shaft 81 is rotatable with respect to the bearing 86 and also movable in the axial direction. When the short shaft 81 is pushed inside of the side frame 22, the connecting members 62, 63 at both ends of the take-up roll 14 are connected to short shafts 73, 81 facing thereto, respectively. When the short shaft 81 is put out of the side frame 22, each one of the connections between the connecting members 62, 63 and the short shafts 73, 81 is separated, whereby the take-up roll 14 can be taken out easily. The incorporation of the take-up roll 14 into the cleaner can be easily made by connecting the connecting member 63 to the short shaft 73 and subsequently another connecting member 62 to the short shaft 81, followed by insertion of the short shaft 81 into the member.

Disposed between the short shaft 81 and the bearing 86 is a means for applying click motion to the short shaft 81 to stop the shaft at the connecting position or the separating position. An example of such a means comprises, as shown in FIG. 9, a pair of annular grooves 90, 91 disposed on the short shaft 81 with a predetermined distance, a ball 92 engaged with the annular groove which is aligned with a tapped opening 93 of the bearing 86, a compression coiled spring 94 applying elastic force to the ball in a direction of the annular groove, and a screw means 95 is screwed in the tapped opening 93 to compress the spring. With the reciprocation of the short shaft 81, the ball 92 is engaged with either one of the annular grooves 90, 91 to stop the short shaft 81 at the connecting position of the separating position. When the short shaft 81 is pushed out and then the ball 92 is engaged with the annular groove 91, the engagement between the pin 84 and the claws 82, 82 is removed. A stopper 96 is fixed to the short shaft 81.

The take-up roll 14 is intermittently rotated by an actuating means. As the actuating means, an annular boss 98 of a crank arm 97 is mounted on the shaft 73 by way of a one-way clutch 99 (FIG. 9). The end portion of the crank arm 97 is pivotally mounted to one end of a connecting member 100 by means of a pin 101 (FIG. 4 and FIG. 9). Another end portion of the connecting member 100 is pivotally mounted to a piston rod 102 by means of a pin 103, and the piston rod 102 is reciprocated by an air cylinder 104 (FIG. 4). The piston rod 102 is at the pulled-back position in FIG. 4, and when the piston rod is pushed toward a direction of arrow B by means of the cylinder 104, the crank arm 97 is rotated in a direction of arrow C by way of the connecting member 100. In the rotation, the shaft 73 is rotated in the same direction C by means of the one-way clutch 99 to move concomitantly the take-up roll 14 in the same direction thereby taking up the cleaning cloth 7. The terminal end of the taking-up side of the cleaning cloth 7 is adhered to the axis 15 by using an adhesive double-sided tape. When the piston rod 102 is returned to the pulled-back position from the extended position, the crank arm 97 rotates in a direction opposite to the arrow C, but during which the short shaft 73 does not move concomitantly because of the one-way clutch 99. As described above, the take-up roll 14 is rotated intermittently by reciprocation of the piston rod 102 to advance the cleaning cloth 7 intermittently. The one-way clutch 77 prevents the short shaft 73 from reversely rotating.

Figure 12:
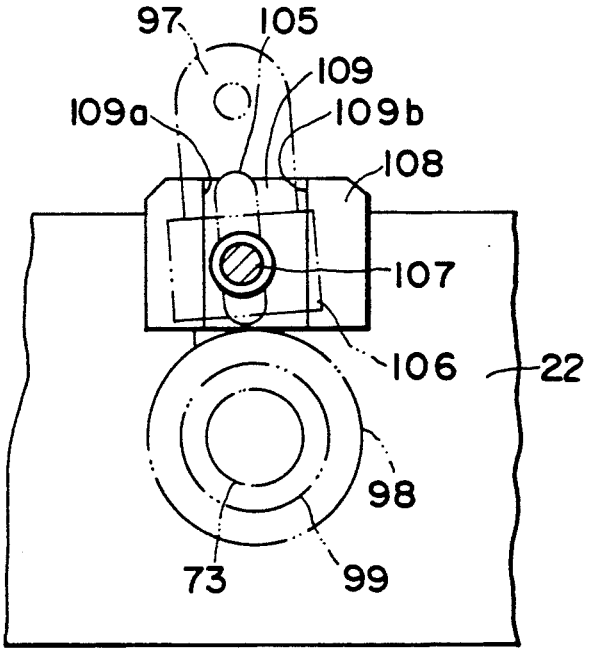
FIG. 12 is a sectional view taken along line XII—XII of FIG. 9.

With the increase of a radius of cleaning cloth 7 taken up around the take-up roll 14, when the rotation angle of the crank arm 97 is constant, the length of the cleaning cloth to be advanced per one time becomes longer, resulting in uneconomical operation. It is preferable to maintain the length to be advanced constant. An example of a means for the constant advancement comprises an elongated slot 105 extending in a radial direction of the crank arm 97, and a sliding carrier 106 mounted on the crank arm (FIG. 9). The sliding carrier 106 has a pin 107 extending through the sliding carrier and the pin 107 is movable along the longitudinal slot 105 of the crank arm. One end of the pin 107 faces a controlling slot 109 of a controlling member 108 fixed to the side frame 22, slides between both side edges **109*a* and 109*b* of the slot (FIG. 12), and defines the sliding angle of the crank arm 97 to control the rotating angle of the take-out roll 14. The length of the cleaning cloth 7 to be advanced per one reciprocation of the crank arm 97 is thereby determined. Another end of the controlling pin 107 is provided with a controlling roller 110 (FIG. 9), and the roller is brought into contact with the cleaning cloth 7 around the take-up roll 14 by gravity of the sliding carrier 106, pin 107, roller 110, etc. Hence, with the increase of the radius of the taken-up cleaning cloth, the roller 110 moves the pin 107 concomitantly with the radius of the taken-up cleaning cloth 7 in such a direction that the pin 107 becomes farther from the center of the take-up roll 14 along the extension line of the radius by way of the crank arm 97 and the sliding carrier 106. Accordingly, the swinging angle of the pin 107 becomes smaller, resulting in the reduction of the sliding angle of the crank arm 97, whereby the wound length of the cleaning cloth 7** can be maintained constant.

The air cylinder 104 is fixed to a bracket 111, and the bracket is mounted on the connecting rod 33 and also fixed to a mount 113 by means of a connecting plate 112 (FIG. 4).

The rollers 30 are provided before and after the said frames 22, 22, respectively, and fixed to the bolt 28 screwed in the connecting rods 24, 34 (FIG. 6 and FIG. 7), and rotatively transfer on a rail 114. The rail 114 is provided with an air cylinder 115 by using a bracket 116 (FIG. 2), and a piston rod 117 of the air cylinder is connected to the side frame 22 by using a bracket 118. When the side frame 22 is advanced toward the right on the rail 114 by the air cylinder 115, the bracket 16 moves close to the blanket cylinder 4 and presses the cleaning cloth 7 stretched between the supporting points 8 and 9 against the peripheral surface of the blanket cylinder 4. When the side frame 22 is advanced toward the left from the position by the air cylinder 115, the cleaning cloth 7 is separated from the blanket cylinder 4. Hence, the operations of pressing the cleaning cloth against and separating it from the blanket cylinder can be made easily.

Figure 13:
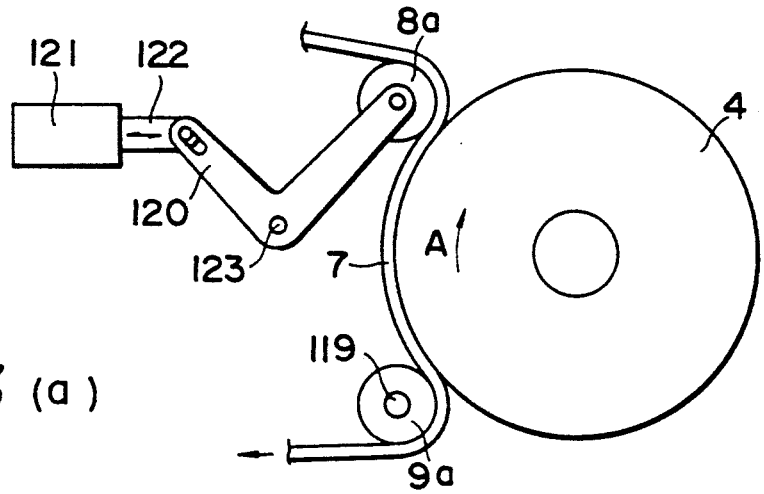
FIGS. 13 (*a*) to (*c*) are schematic views showing various embodiments of the moving process of supporting points for the stretched cleaning cloth.
Figure 13:
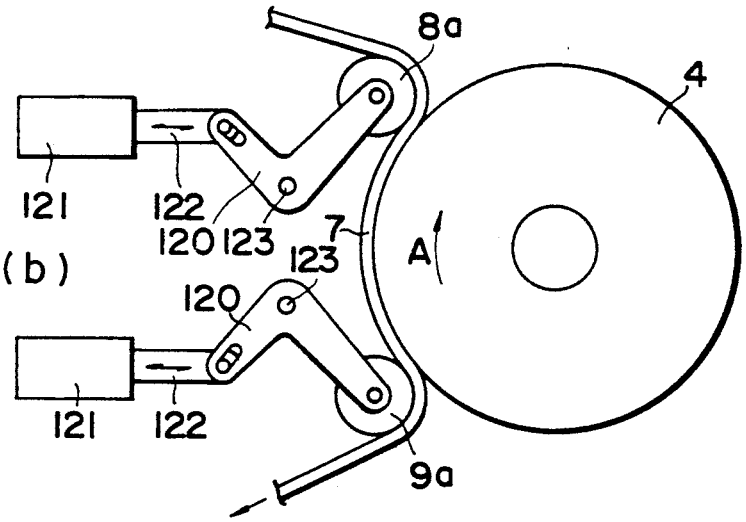
Figure 13:
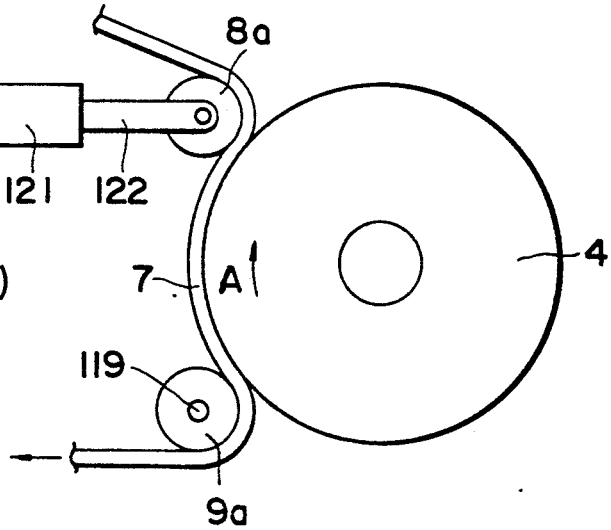

One example of the method for pressing the cleaning cloth 7 against and separating it from the blanket cylinder 4 comprises a construction in which the roll 9*a* is pivotally mounted around a fixed shaft 119, another roll 8*a* is pivotally mounted around one end portion of a bell crank 120, another end portion of the bell crank 120 is pivotally mounted to a piston rod 122 of an air cylinder 121, and the air cylinder 121 swings the bell crank 120 around a fixed center 123 to thereby moving the roll 8*a* (FIG. 13*a*). The rolls 8*a*, 9*a* are both connected to the bell cranks 120, 120, and these bell cranks are swingably moved around the fixed center 123 by the air cylinder 121 to thereby moving rolls (FIG. 13*b*). Further, the roll 9*a* is rotated around the fixed center 119, another roll 8*a* is pivotally mounted on the piston rod 122 of the air cylinder 121, and thereby the air cylinder moves the roll directly (FIG. 13*c*). As described above, either one or both of the rolls 8*a*, 9*a* for stretchedly disposing the cleaning cloth are moved by the air cylinder 121 to press the cleaning cloth against or separate it from the rotary bodies, and thereby the whole body of the cleaner becomes The cleaning cloth 7 is intermittently advanced in succession by a length of about 5 mm per one reciprocation of the piston rod 102, and cleaning liquid is sprayed from the jet opening 10 to the advanced cloth to wash the blanket cylinder 4. After the cleaning is conducted ten times, the spraying of the cleaning liquid is stopped and subsequently the cleaning cloth 7 is advanced about ten times to wipe the cleaning liquid on the washed surface. During this operation, the revolution of the blanket cylinder 4 is about 6,000 to 7,000 per hour.

Figure 14:
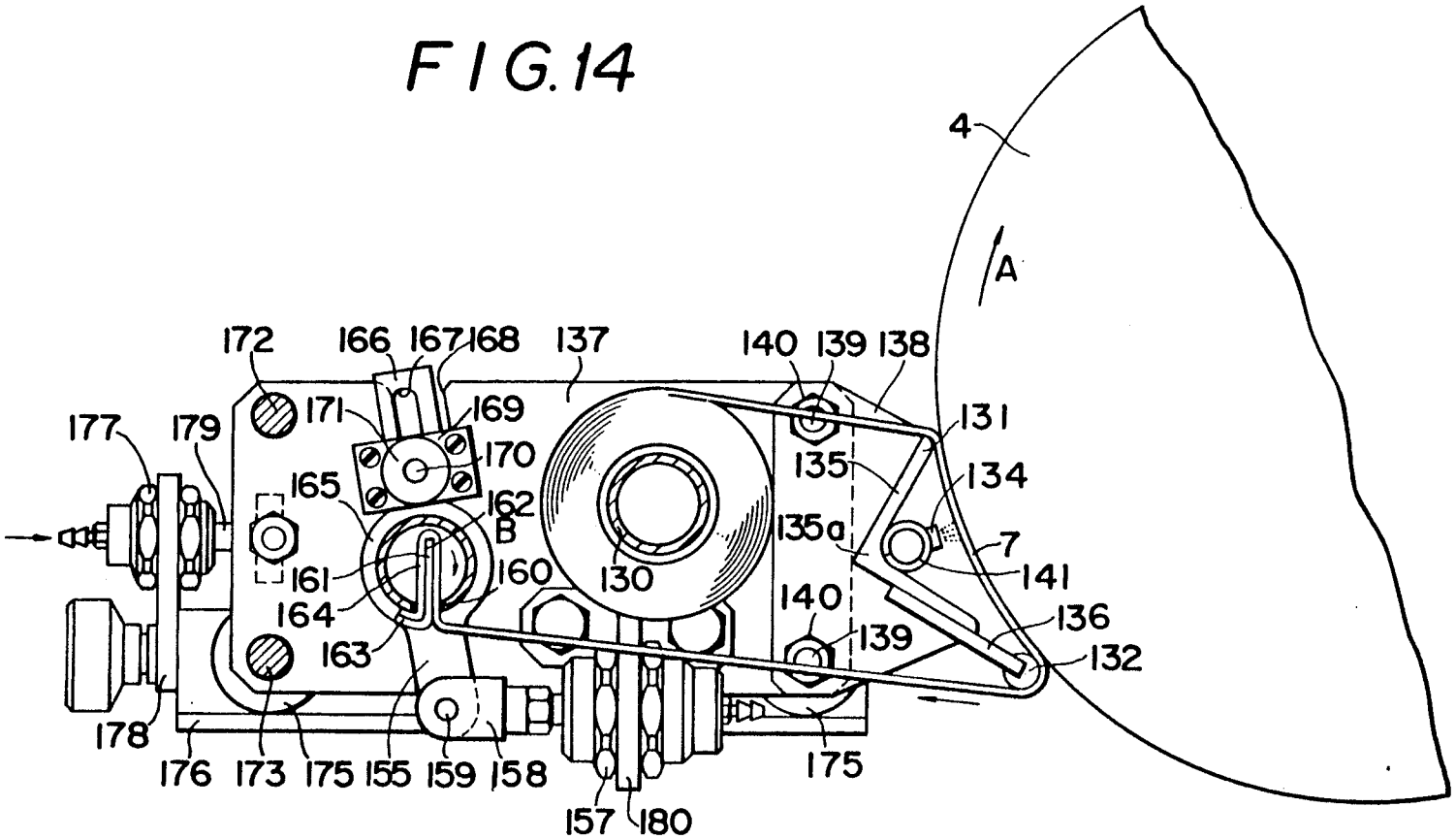
FIG. 14 is a sectional view taken along line XIV—XIV of FIG. 15.
Figure 15:
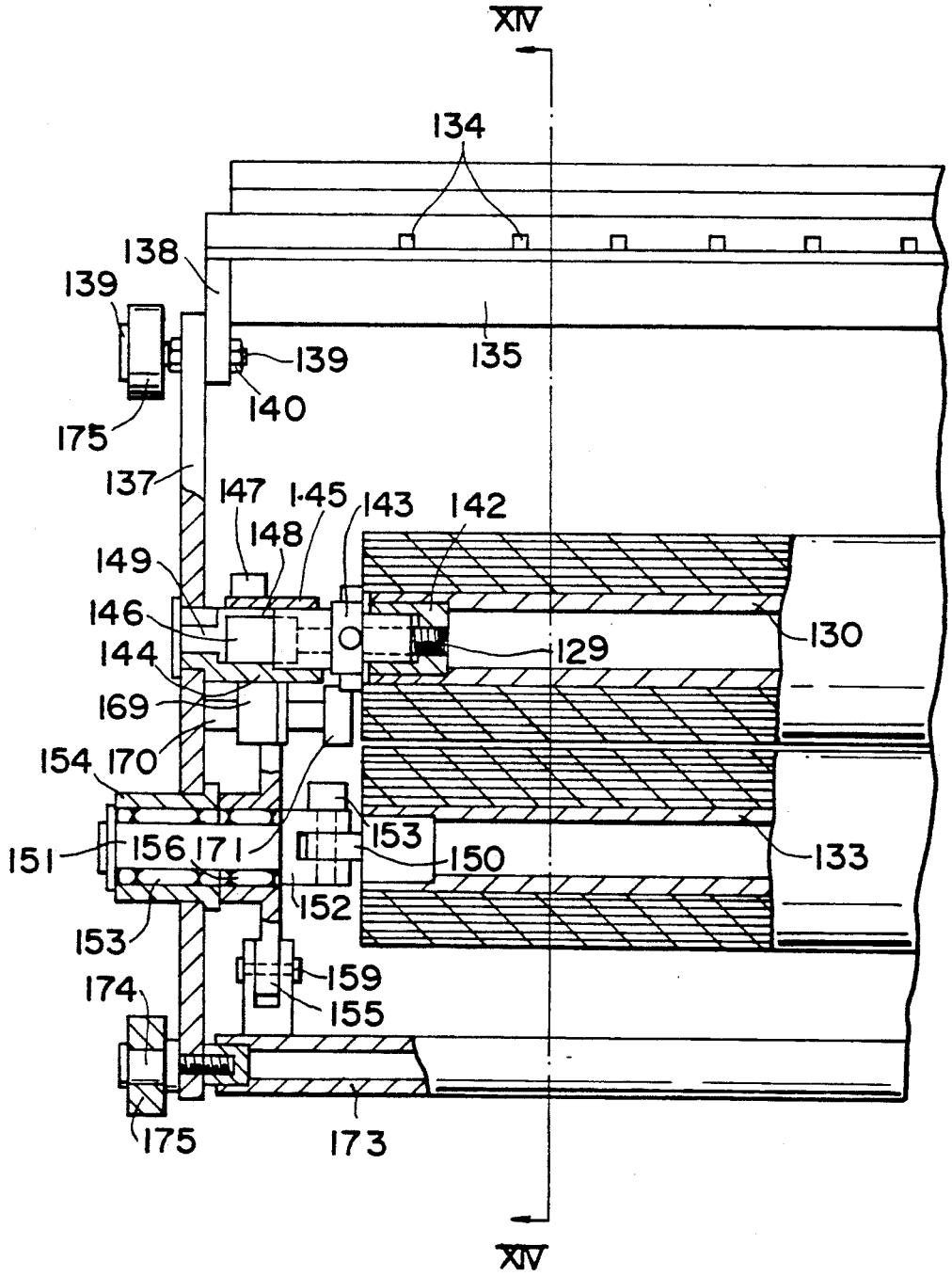
FIG. 15 is a plan view showing another embodiment of the inventive cleaner, with parts broken away and parts omitted.

The drawings of FIG. 14 and FIG. 15 show a second embodiment of the present invention. The cleaning cloth 7 is taken-up from the roll on a cleaning cloth supply roll 130 to a cleaning cloth take-up roll 133 by way of the supporting points 131, 132. The taking-up roll 133 supplies new cleaning cloth 7 successively to the cleaning position. A nozzle 134 sprays cleaning liquid to the cleaning cloth 7 between the supporting points 131, 132 from the back thereof. The cleaning cloth 7 is pressed against the blanket cylinder 4 and is concomitantly moved to clean the blanket cylinder. The description concerning the cleaner of the second embodiment given hereinabove is basically the same as that for the cleaner of the first embodiment. Hereinbelow, the different points of the cleaner of the second embodiment will be described.

One supporting point 131 supporting the cleaning cloth 7 in the stretched condition is formed integrally at one end of a stretching member 135 with a section of mountain shape, and another supporting point 132 is formed in a circular shape at the end portion of a plate-like stretching member 136. The supporting point 132 is positioned farther from an aspect 135*a* of the member 135 than another supporting point 131. The supporting point 132 positioned at the farther point faces toward the direction opposite to the rotation A of the subject to be cleaned such as the blanket cylinder 4 and the like. The stretching member 135 extends from a side frame 137 to another corresponding side frame (not shown) and is fixed to both side frames by means of a bracket 138. Specifically, the bracket 138 is fixed to the side frame 137 by means of a bolt 139 and a nut 140. The stretching member 135 is fixed to the bracket 138 by welding and functions of maintaining the distance between both side frames. The corner portion of the stretching member 135 is fixed to a jet tubular member 141 and the jet tubular member also has a length equal to the distance between the side frames 137, 137. The nozzles 134 provided on the jet tubular member 141 are arranged spaced apart at an equal distance so that the cleaning liquid can be evenly distributed over the whole width.

The connection and separation of the cleaning cloth supply roll 130 with the side frame 137 are substantially the same as in the case of the above first example. A connecting socket 142 at the end portion of the cleaning cloth supply roll 130 and the short shaft 143 are fixed by means of a bolt 129. The short shaft 143 is supported by a bearing 144 and confined within the bearing by a cover 145. The cover 145 is connected to a brake shoe 146 by a bolt 147, and serves to open and shut an opening 148 of the bearing 144. In the opening state of the cover 145, the short shaft 143 is inserted in and removed out from the bearing 144 through the opening 148. An adjust screw 149 is screwed in a tapped opening of the bearing 144 and presses the brake shoe 146 against the short shaft 143.

The cleaning cloth take-up roll 133 has a plug 150 at the terminal end. The plug is inserted in a two-way socket 152 of the short shaft 151, and these are connected to each other by a bolt 153. When the bolt 153 is removed from the socket 152 and the plug 150, the plug 150 can be separated from the socket 152.

The short shaft 151 is supported by the bearing 154 by way of a one-way clutch 153 and thereby rotated one-way as in the case of the first example.

A cleaning cloth advance arm 155 is mounted on the short shaft 151 by means of a one-way clutch 156 similarly as in the first example, and one end portion of the arm is connected to a piston rod 158 of the air cylinder 157 by a pin 159. The air cylinder 157 is connected to the side frame 137 by a bracket 180. When the piston rod 158 is reciprocated linearly by the air cylinder 157, the cloth advance arm 155 swings to rotate the short shaft 151 only in a direction of an arrow B. By this operation, the take-up roll 133 winds up the cleaning cloth 7 from the cloth supply roll 130. The take-up roll 133 is provided with a narrow longitudinal slot 160 over the whole length of the roll, and a cloth press means 161 is inserted in and over the whole length of the slot. The cloth press means 161 comprises an insert portion 162 having a length which is somewhat shorter than the diameter of the take-up roll 133 and a cloth press portion 163 bending along the take-up roll 133 from one end of the cloth insert portion 162. The sectional shape of these two elements extends over the whole length of the take-up roll 133. The terminal end 164 of the cleaning cloth to be taken-up is inserted in the take-up roll by an insert section 162 of the cloth press means 161 through the longitudinal slot 160 of the take-up roll 133, and pressed against the take-up roll. Upon one rotation of the take-up roll, the terminal end of the cleaning cloth to be taken-up is tightly engaged with the take-up roll.

The cloth advance arm 155 has a control arm 166 extending toward the direction opposite to the arm from a center of swing 165, and the control arm is provided with a guide slot 167. A slider 169 is slidably mounted on the control arm 166 and a control pin 170 is fixed to the slider 166. One end of the control pin 170 faces a control slot 168 formed on the side frame 137 and swings in the slot between both side edges to define the swing angle of the cloth advance arm 155 and thereby control the rotation angle of the take-up roll 133. Resultingly, the length of the cleaning cloth 7 advanced per one reciprocation of the cloth advance arm 155 is determined. A control roller 171 is loosely engaged around another end of the control pin 170. The roller 171 is brought into contact with the cleaning cloth 7 on the take-up roll 133 by the gravity of the slider 169, pin 170, roller 171 and the like.

Accordingly, the length of the cleaning cloth 7 to be taken up is maintained constant even if the diameter of the roll of the taken-up cleaning cloth 7 becomes larger similarly as in the case of the first example.

The side frames 137, 137 facing each other have a front end part which is connected by the stretching member 135 and a rear end part which is connected by connecting rods 172, 173, respectively. The connecting rod 173 is connected to the side frame 137 by a shaft 174, and a roller 175 at the rear side is engaged on the shaft 174. A roller 175 at the front side is engaged on the bolt 139. These rollers 175 relatively move on a rail 176. An air cylinder 177 is installed on the rail 176 by a bracket 167 and has a piston rod 179 connected to the side frame 137. When the side frame 137 is advanced toward the right-hand on the rail 176 by the air cylinder 177, the stretching members 135, 136 move closer to the blanket cylinder 4 and press the cleaning cloth 7 stretched between the two supporting points 131, 132 against the peripheral surface of the cylinder, while when the side frame 137 is moved to the left-hand by the air cylinder 177, the cleaning cloth 7 is separated from the blanket cylinder 4.

What is claimed is:

1. A cleaner for cleaning a rotary body such as a blanket cylinder, impression cylinder, ink supply rollers and the like, comprising: a cleaning cloth having a portion stretched between two supporting points so that said portion is in full surface contact with and may be pressed against a peripheral surface of a rotary body to be cleaned; means for supplying a washing material onto the back of the cleaning cloth; means for advancing the cleaning cloth in a direction opposite to the rotation of the peripheral surface of the rotary body, the means for advancing comprising a supply roll for supplying the cleaning cloth between the supporting points and a take-up roll for taking up the cleaning cloth from the supporting points; bearings for supporting both ends of the supply roll; and braking means for braking the supply roll comprising a brake shoe disposed in at least one of the bearings and means for controlling the brake force of each brake shoe to thereby control the stretched force of the cleaning cloth; wherein the bearings include an opening for attaching and detaching the supply roll and a cover rotatably connected to the brake shoe to open and shut the opening for attachment and detachment.

2. A cleaner according to claim 1, further comprising pressing means for pressing the cleaning cloth against the peripheral surface of the rotary body.

3. A cleaner according to claim 2, wherein the pressing means comprises a press roll disposed between the supporting points for pressing the cleaning cloth against the rotary body.

4. A cleaner according to claim 1, wherein at least the supporting point on the taking-up side is composed of a rotary roll.

5. A cleaner according to claim 1, wherein the supporting point positioned at the taking-up side is composed of a rotary roll and the other supporting point positioned at the supplying side is composed of a stationary body.

6. A cleaner according to claim 1, wherein both of the supporting points are composed of stationary bodies.

7. A cleaner according to claim 1, further comprising a pair of side frames to which the supporting points, the cleaning cloth supply roll and the cleaning cloth take-up roll are disposed, rollers disposed on both side frames, a rail supporting the rollers, a cylinder for reciprocating the side frames between a cleaning position at which the cleaning cloth is brought into contact with the rotary body and a non-cleaning position at which the side frames separate from the rotary body.

8. A cleaner according to claim 1, wherein both the supporting points are composed of rotary rolls.

9. A cleaner according to claim 8, further comprising a press roll disposed between the supporting points for pressing the cleaning cloth against the rotary body, wherein the rotary rolls and the press roll are covered by a flexible, elastic material made of rubber, synthetic resin and the like.

10. The cleaner according to any of claims 4, 8, 5 or 9, further including an air cylinder, and wherein at least one of the rotary rolls for stretchedly disposing the cleaning cloth transfers the cleaning cloth in such a direction that the cleaning cloth is brought into contact with or separated from the peripheral surface of the rotary body by the air cylinder.

11. The cleaner according to any of claims 4, 8, 5 or 9, further comprising an air cylinder, and wherein the two rotary rolls for stretchedly disposing the cleaning cloth transfer the cleaning cloth in such a direction that the cleaning cloth is brought into contact with and separated from the peripheral surface of the rotary body by the air cylinder.

12. A cleaner for cleaning a rotary body such as a blanket cylinder, impression cylinder, ink supply rollers and the like, comprising: a cleaning cloth having a portion stretched between two supporting points so that said portion is in full surface contact with and may be pressed against a peripheral surface of a rotary body to be cleaned; means for supplying a washing material onto the back of the cleaning cloth; means for advancing the cleaning cloth in a direction opposite to the rotation of the peripheral surface of the rotary body, the means for advancing comprising a supply roll for supplying the cleaning cloth between the supporting points and a take-up roll for taking up the cleaning cloth from the support points; two short shafts; bearing means for supporting the short shafts; connecting means for connecting each end of the take-up roll to the short shafts, respectively; wherein one of the short shafts is axially movable between a separation position and a connection position to conduct separation and connection of the take-up roll and said one support shaft; and means for automatically axially stopping said one support shaft at the separation position and the connection position, the means for automatically stopping said one short shaft comprising an annular groove for the separation position and an annular groove for the connection position which are provided on said one short shaft, a ball inserted in an opening of the bearing means and engageable with the annular grooves, and a spring for pressing the ball against the annular grooves.

13. A cleaner for cleaning a rotary body such as a blanket cylinder, impression cylinder, ink supply rollers and the like, comprising: a cleaning cloth having a portion stretched between two supporting points so that said portion is in full surface contact with and may be pressed against a peripheral surface of a rotary body to be cleaned; means for supplying a washing material onto the back of the cleaning cloth; means for advancing the cleaning cloth in a direction opposite to the rotation of the peripheral surface of the rotary body, the means for advancing comprising a supply roll for supplying the cleaning cloth between the supporting points and a take-up roll for taking up the cleaning cloth from the supporting points; two short shafts; bearing means for supporting the short shafts; and connecting means for connecting each end of the take-up roll to the short shafts, respectively, the connecting means comprising a slot disposed on each of the short shafts, each slot having an opening therein, a plug extending from each end of the take-up roll and engaged in a respective one of the slots, and a connecting pin inserted in the opening of each slot for locking the plug in position.

14. A cleaner for cleaning a rotatable body, comprising: a frame, a first supporting point supported on the frame; an second supporting point supported on the frame in spaced relation from the first supporting point; a cleaning sheet having a portion stretched between the first and second supporting points, said portion being engageable with an outer peripheral surface of a rotatable body in full surface contact therewith and movable relative thereto to effect cleaning of the peripheral surface of the rotatable body during use of the cleaner; advancing means for advancing the cleaning sheet in a direction opposite a direction of rotation of the rotatable body to change the portion of the cleaning sheet stretched between the first and second supporting points, the advancing means comprising a supply side roll for supplying the cleaning sheet and a take-up side roll for taking up the cleaning sheet; two short shafts; bearing means for supporting the short shafts; the take-up side roll being separably connected at a first end and a second end to the two short shafts, respectively, and one of the short shafts being axially movable between separation and connection positions of the take-up roll and the short shafts; and means for automatically axially stopping the one short shaft at the separation position and the connection position, the means for automatically stopping the one short shaft comprising an annular groove for the separation position and an annular groove for the connection position provided on the one short shaft, a ball inserted in an opening of the bearing means and engageable in the annular grooves, and a spring for pressing the ball against the annular grooves.

15. A cleaner according to claim 14, further comprising means for spraying a cleaning liquid to a backside of the cleaning sheet.

16. A cleaner according to claim 15, further comprising pressing means for pressing the cleaning sheet against the rotatable body.

17. A cleaner according to claim 16, wherein the pressing means comprises at least one press roll for pressing the cleaning sheet against the rotatable body.

18. A cleaner according to claim 17, wherein each press roll is covered by a flexible elastic material.

19. A cleaner according to claim 14, further comprising braking means for braking the advancement of the cleaning sheet at a supply side to control the stretch force of the cleaning sheet.

20. A cleaner according to claim 14, further comprising means for detachably supporting the supply side roll on the frame.

21. A cleaner according to claim 14, wherein the first and second supporting points each comprise a rotary roll.

22. A cleaner according to claim 21, wherein each rotary roll is covered by a flexible elastic material.

23. A cleaner according to claim 14, wherein the first and second supporting points each comprise a stationary member.

24. A cleaner according to claim 14, wherein one of the first and second supporting points comprises a stationary member and the other comprises a rotary roll.

25. A cleaner according to claim 14; further including rollers rotatably mounted on the frame; a set of rails supporting thereon the rollers; and a cylinder for reciprocating the frame along the rails between a cleaning position at which the cleaning sheet is brought into contact with the rotatable body and a non-cleaning position at which the cleaning sheet is separated from the rotatable body.

26. A cleaner according to claim 14; further comprising bearings for supporting both ends of the supply roll; and braking means for braking the supply roll, the braking means including a brake shoe disposed in at least one of the bearings, and means for controlling the brake force of each brake shoe to thereby control the stretch force of the cleaning sheet.

* * * * *